US007147481B2

(12) United States Patent
Yang

(10) Patent No.: US 7,147,481 B2
(45) Date of Patent: Dec. 12, 2006

(54) SHIELDED ELECTRICAL CONNECTOR WITH ANTI-MISMATCHING MEANS

(75) Inventor: Meng-Huan Yang, Tu-Chun (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/148,503

(22) Filed: Jun. 8, 2005

(65) Prior Publication Data

US 2006/0063431 A1 Mar. 23, 2006

(30) Foreign Application Priority Data

Sep. 21, 2004 (CN) ..... 2004 2 0079814

(51) Int. Cl.
*H01R 12/00* (2006.01)

(52) U.S. Cl. ..... 439/71; 439/330; 439/607

(58) Field of Classification Search ..... 439/607, 439/71, 330; 361/816, 818
See application file for complete search history.

(56) References Cited

U.S. PATENT DOCUMENTS 4,337,989 A * 7/1982 Asick et al. ..... 439/609
6,210,240 B1 * 4/2001 Comerci et al. ..... 439/853
2003/0218873 A1 11/2003 Nokia
2005/0215117 A1 * 9/2005 Asai et al. ..... 439/607

* cited by examiner

*Primary Examiner*—Neil Abrams
(74) *Attorney, Agent, or Firm*—Wei Te Chung

(57) ABSTRACT

An shielded electrical connector (100) for fastening therein an electrical element (5) witch is formed with a plurality of protrusions (5111, 5121, 5131, 5141), includes an insulatire housing (3), a number of terminals (2), a side shield (1) and a bottom shield (4). The side shield includes a number of separated shielding plates (11, 12, 13, 14) mounted around the insulative housing. Each shielding plate has a number of flexible plates (15) formed in U-shape with a free end extending downwardly and inwardly for pressing against the electrical element. The side shield further defines a plurality of engaging holes (123, 143) for insertion of soldering portions of the terminals. This arrangment of tabs (24) enables the connector to be either top or bottom loads through an opening in a printed circuit board. Some of the plates (15) include cutouts (151), which are to receive the protrusions (5111, etc) for locking and orientation purposes.

14 Claims, 5 Drawing Sheets

SHIELDED ELECTRICAL CONNECTOR WITH ANTI-MISMATCHING MEANS

BACKGROUND OF THE INVENTION

1. Field of the Invention

The present invention generally relates to a shielded electrial connector,particularly to a shielded electrical connector for recieving an electrical element therein.

2. Description of the Prior Art

A conventional shielded electrical connector is described in U.S. Patent Application Publication No. 2003/0218873, which was publicated on Nov. 27, 2003. The shielded electrical connector comprises a fastening structure for fastening an electrical element 3, which is formed with a plurality of projections. The fastening structure comprises a frame 1 with a plurality of flexible fastening means 11 arranged therearound, and an adapter 2 with a plurality of U-shaped tenninals mounted on. The fastening means 11 are arranged to place against the electrical element 3, with a plurality of stopper means 13 defined thereon for engaging with the projections of the electrical element 3. The adapter 2 together with the terminals is placed between the electrical element 3 and a bottom of the frame 1. Each U-shaped terminal having a soldering portion formed at a free end thereof and located below the adapter. The soldering portions extend outwardly from the bottom of the frame 1.

As is described above, when the electrical element 3 is fitted in the frame 1, the flexible fastening means 11 according to the invention yield to the electrical element 3. A similar yielding of the fastening means 11 also occurs when the electrical element 3 is removed from the frame 1. As a result, it is easy to make the flexible fastening means 11 have a distort and thus hard to fasten the electrical element 3 firmly when the frame 3 is used for a certain long time. Moreover, the soldering portions of the terminals used to be soldered onto a Printed Circuit Board (PCB) extend outwardly from the bottom of the frame 1 and are located below the bottom. As a result, the fastening structure could only be soldered onto a PCB formed as a substantially flat plate in an up-to-down manner. When the structure need to be soldered onto a PCB, on which a hole adapted for receiving the structure is defined, it would be hard for the soldering portions to reach the PCB.

Hence, an improved shielded electrical connector is required to overcome the disadvantages of the prior art.

BRIEF SUMMARY OF THE INVENTION

An object of the present invention is to provide an shielded electrical connector having a plurality of improved flexible plates.

Another object of the present invention is to provide an improved shielded electrical connector capable of being soldered onto any kinds of PCB in various of manners.

To achieve the aforementioned objects, an shielded electrical connector for receiving therein an electrical element which is formed with a plurality of protrusions, comprises an insulative housing formed as a substantially flat plate, a plurality of terminals mounted in the insulative housing, a side shield and a bottom shield. The side shield comprises a plurality of separated shielding plates mounted around the insulative housing. Each shielding plate has a body portion and a plurality of flexible plates formed in U-shape, with a free end extending downwardly and inwardly for standing against the electrical element. The side shield further defines a plurality of engaging holes for insertion of the terminals.

The bottom shield is attached to a bottom of the insulative housing, and cooperates with the side shield to substantially encase therein the insulative housing together with the terminals.

To compare with the conventional invention, one merit of this invention is making the flexible plates stand against the electrical element. When the electrical element is guided in, the flexible plates are pressed and deflected. As a result, an exerted force provided by the electrical element is transferred from the flexible plates to the body portion of the shielding plates, and thus would be reduced though a longer path. The body portion receives the exerted force indirectly and would hard to be deflected, thus the life of the side shield would be prolonged.

Another merit of this invention is defining a plurality of engaging holes on the side shield for insertion of the terminals. The terminals could extend to the outside laterally through the engaging holes. Thus, when the electrical connector needed to be soldered onto a PCB formed as a substantially flat plate or defines a hole for receiving the electrical connector, it is easy for the terminals to reach the PCB and be soldered on to the PCB in various of manners, such as in a top-to-bottom manner or in a bottom-to-top manner.

Other objects, advantages and novel features of the invention will become more apparent from the following detailed description of a preferred embodiment when taken in conjunction with the accompanying drawings.

DETAILED DESCRIPTION OF PREFERRED EMBODIMENTS

Figure 1:
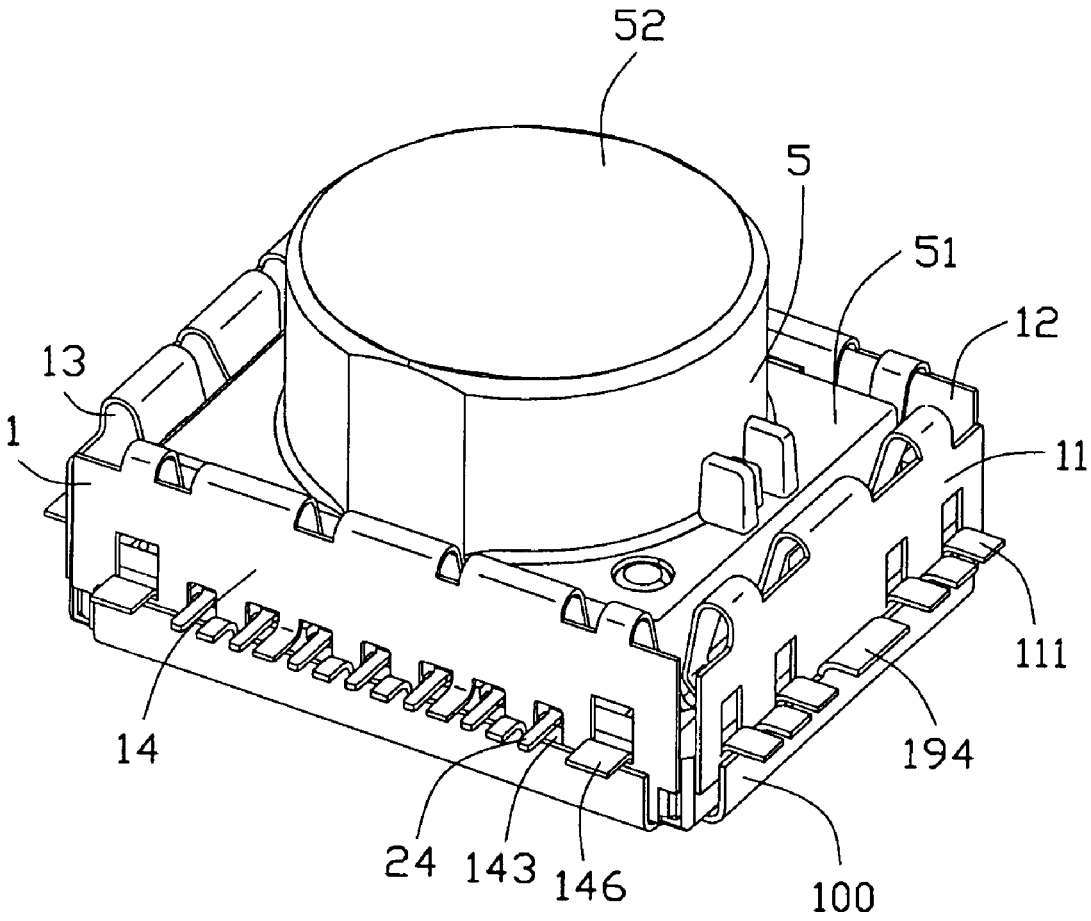
FIG. 1 is a perspective view of an shielded electrical connector in accordance with the present invention which retains therein an electrical element.

Referring to FIGS. 1 to 5, an shielded electrical connector 100 used to retain therein an electrical element 5, which is formed with a plurality of protrusions 5111, 5121, 5131, 5141, comprises an insulative housing 3, a plurality of terminals 2, a side shield 1, and a bottom shield 4.

Figure 4:
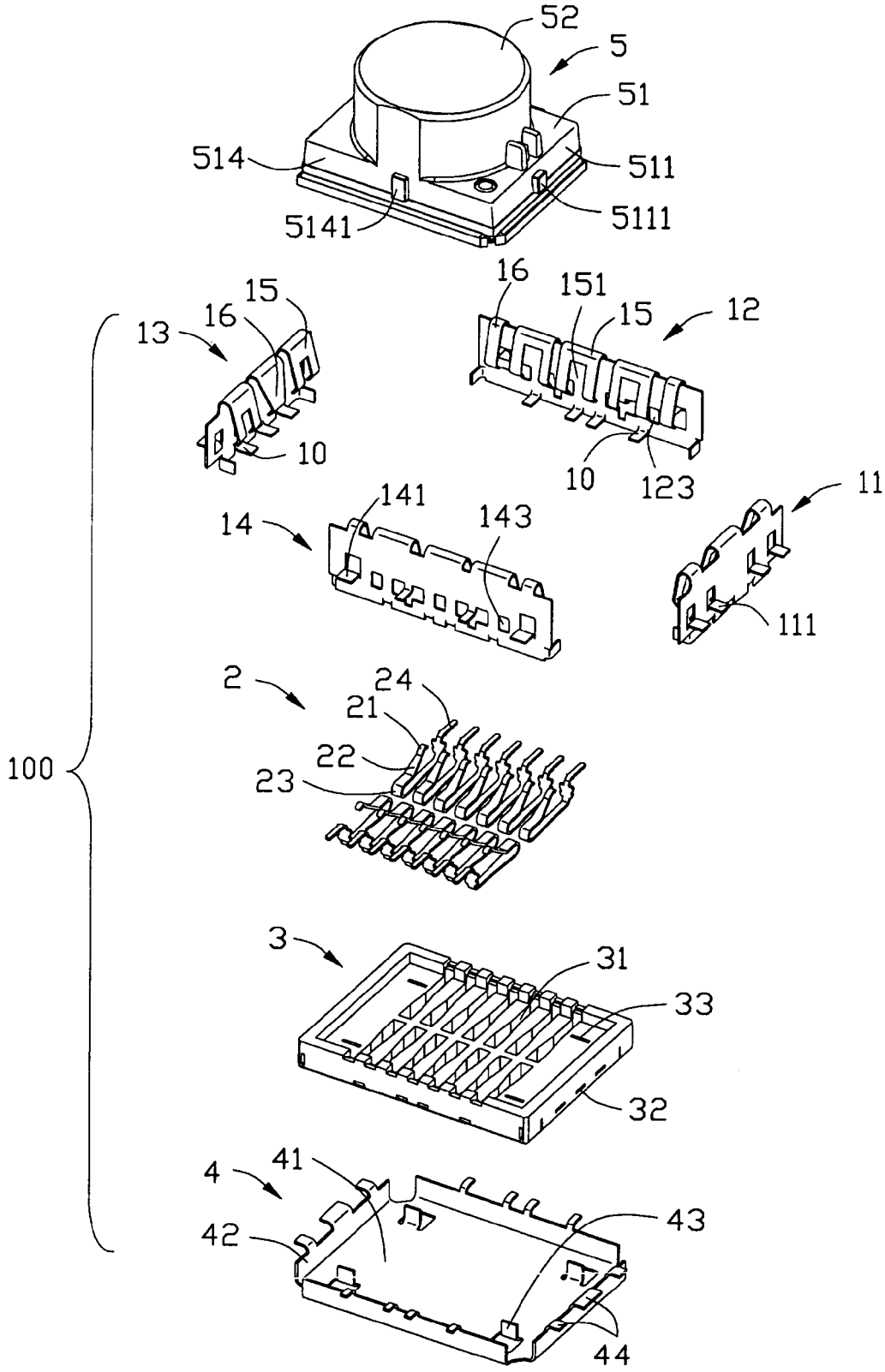
FIG. 4 is an exploded perspective view of FIG. 1.

Referring to FIG. 4, the insulative housing 3 made of insulative material is formed as a substantially flat plate. The insulative housing 3 defines therein a plurality of passageways 31 which are symmetrically arranged in two rows in a longitudinal direction. Four slots 33 are symmetrically defined at corner portions of the insulative housing 3 and extend in a top-to-bottom direction throughout the insulative housing 3. Moreover, the insulative housing 3 has a plurality of slits 32 defined at side faces thereof in a direction perpendicular to the extending direction of the slots 33.

Each terminal 2 made of conductive material, comprises a U-shaped bending portion 23, an extending portion 22 connecting with the U-shaped bending portion 23, a contacting portion 21, and a soldering portion 24. The extending portion 22 extends laterally and upwardly from one end of the bending portion 23. The contacting portion 21 is formed at a free end of the extending portion 22 and located above the bending portion 23. The soldering portion 24 is formed at the other end of the bending portion 23 in a direction away from the bending portion 23. All of the soldering portions 24 are used to be soldered onto a PCB (not shown).

The side shield 1 comprises four separated shielding plates 11, 12, 13, 14 mounted around the insulative housing 3. The shielding plates include a primary plate 11, a pair of opposite side plate 12, 14 which are located respectively perpendicular to two opposite sides of the primary plate 11, and an end plate 13 positioned adjacent to the pair of side plate 12, 14. Each shielding plate has a body portion (not labeled) and a plurality of first flexible plates 15, second flexible plates 16 formed in U-shape and with a free end extending downwardly and inwardly for resiliently standing against the electrical element 5. The anti-mismating means employed in this embodiment is a cutout 151 defined on each first flexible plate 15. The cutouts 151 are formed in a rectangular shape for receiving therein the protrusions 5111, 5121, 5131, 5141 of the electrical element 5. Moreover, the primary plate 11 has the first flexible plates 15 formed in a center portion, to which a pair of the second flexible plates 16 are located adjacent. The pair of side plates 12, 14 respectively has three of the first flexible plates 15 formed thereon, beside which a pair of the second flexible plates 16 are respectively positioned. A pair of the first flexible plates 15 are provided on the end blade 13, of which the second flexible plates 16 is located in a middle.

Each shielding plate 11, 12, 13, 14 further has a plurality of fixing feet 10 formed at a bottom portion thereof with a free end extending inwardly for inserting into the slits 32 of the insulative housing 3. A plurality of grounding tabs 111, 121, 131, 141 are formed at the body portion and extend outwardly and parallel to the fixing feet 10. The pair of side plates 12, 14 respectively defines a plurality of engaging holes 123, 143 thereon for insertion of the soldering portions 24 of the terminals 2.

The bottom shield 4 cooperating with the side shield 1 is attached to a bottom of the insulative housing 3 to encase therein the insulative housing 3. The bottom shield 4 comprises a bottom wall 41, and four side walls 42 extending upwardly from side edges of the bottom wall 41. Moreover, each side wall 42 has a plurality of grounding tabs 44 formed thereon and with a free end extending outwardly and parallel to the grounding tabs 111, 121, 131, 141 of the side shield 1. The grounding tabs 44, 111, 121, 131, 141 and the soldering portions 24 of the terminals 2 are used to be soldered onto the PCB. The bottom wall 41 has four inserting portions 43 formed at corner portions thereof. The inserting portions 43 adapted to be received in the slots 33 project upwardly from the bottom wall 41.

Figure 2:
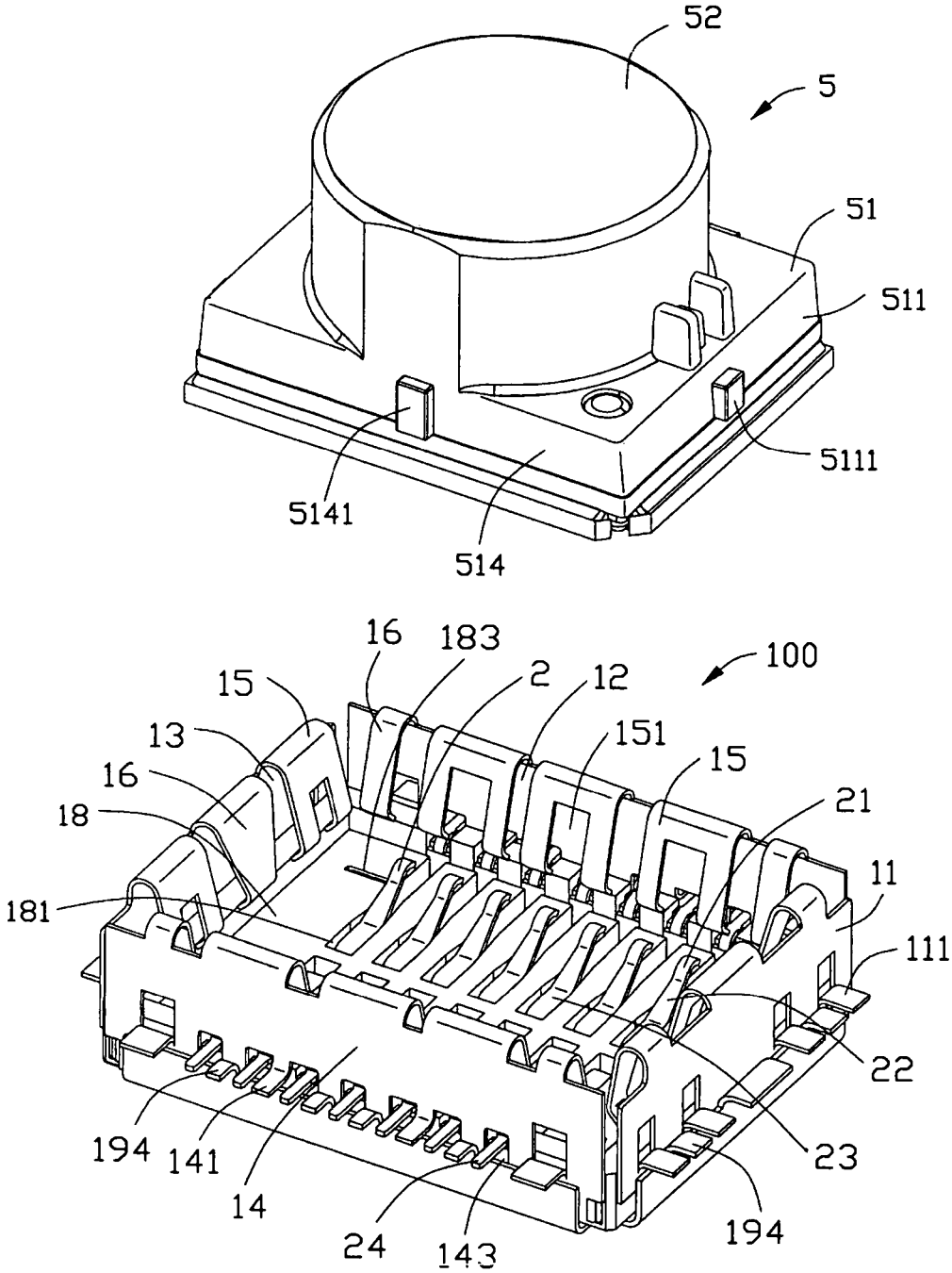
FIG. 2 is a perspective view of the shielded electrical connector before the electrical element being retained therein.
Figure 3:
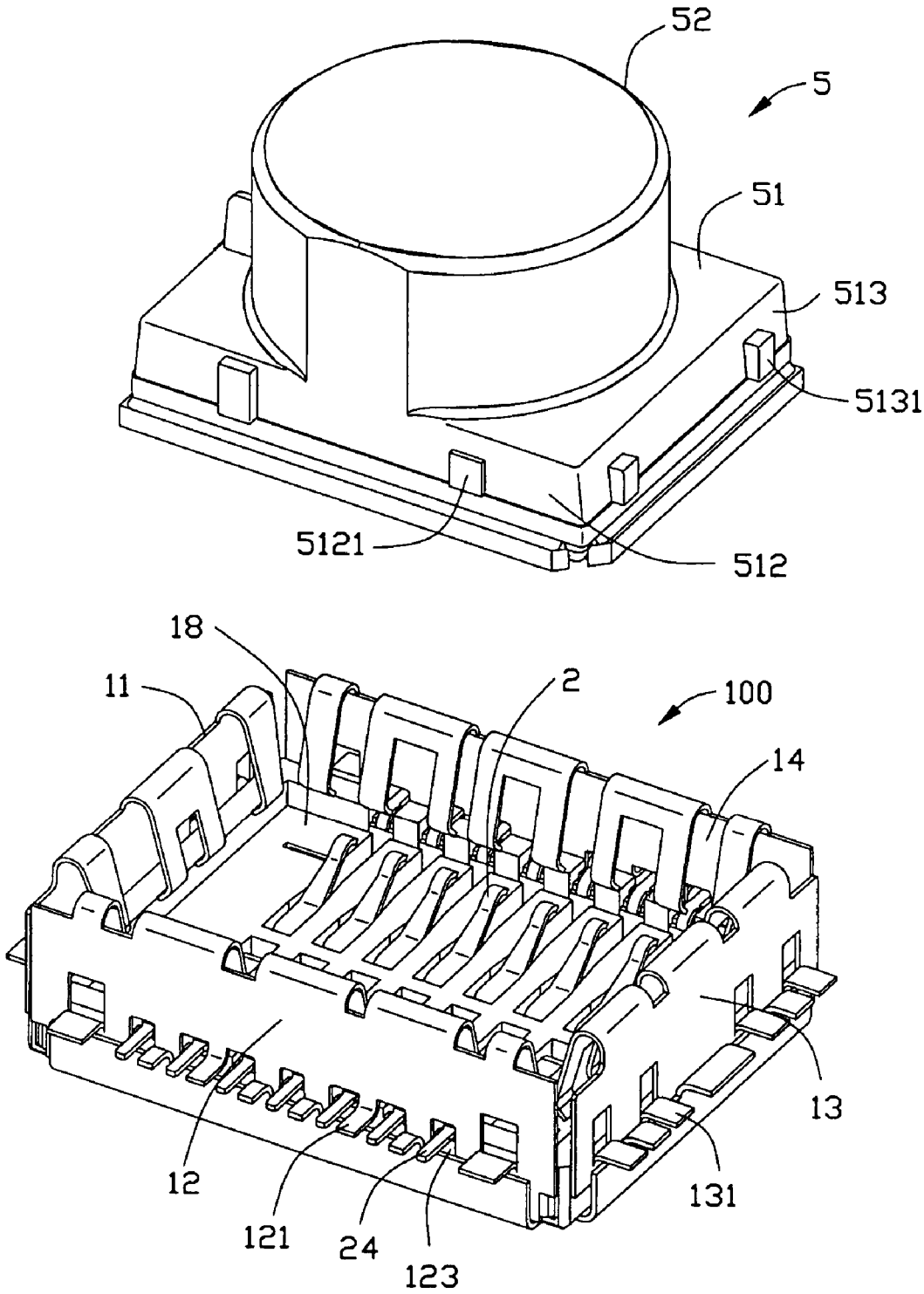
FIG. 3 is another perspective view similar to FIG. 2.
Figure 5:
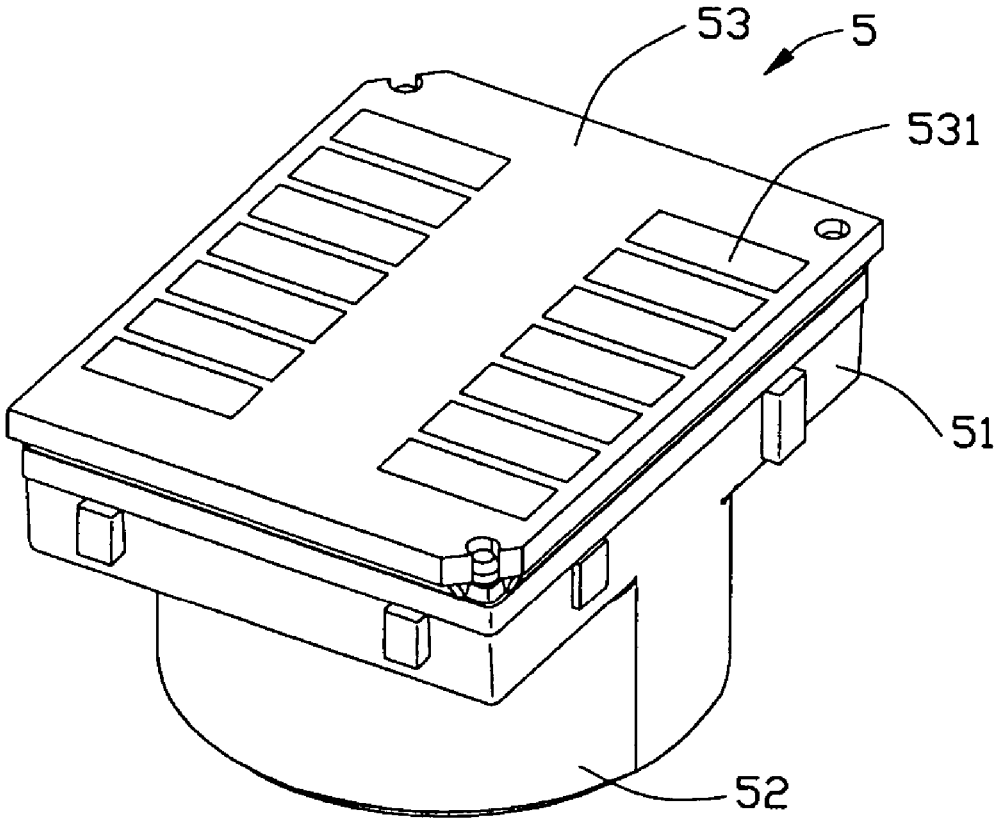
FIG. 5 is a perspective view of the electrical element showing a bottom surface thereof.

Referring to FIGS. 2, 3 and 5, the electrical element 5 employed in this embodiment is a camera module. The camera module 5 comprises a base 51, a columnar portion 52 extending upwardly from the base 51, and a bottom portion 53 laterally extending in directions from a lower portion of the base 51. A first protrusion 5111 and a forth protrusion 5141 respectively projects laterally from a central portion of a pair of perpendicularly jointed side faces 511, 514 of the base 51. The base 51 has a pair of second protrusions 5121, and a pair of third protrusions 5131 respectively projecting laterally form another pair of side faces 512, 513 thereof. A plurality of productive paths 331 are provided on a lower surface of the bottom portion 53 and to be abutted against by the contacting portions 21 of the terminals 2 to establish an electrical connection between them.

Also referring to FIGS. 1 to 4, in assembly, the terminals 2 are mounted in the insulative housing 3 by inserted to the corresponding passageways 31. The bending portions 23 of the terminals 2 are received in the passageways 31 for securing the terminals 2. The side shield 1 engages with the insulative housing 3 in an up-to-down manner. The shielding plates 11, 12, 13, 14 are mounted around the insulative housing 3 with the fixing feet 10 inserted into the corresponding slits 32. The soldering portions 24 extend to the outside of the side shield 1 laterally through the engaging holes 123, 143. The bottom shield 4 is then attached to the bottom of the insulative housing 3 in a bottom-to-top direction, with the inserting portions 43 inserted into the slots 33, and the side walls 42 surrounding side portions of the insulative housing 3 thus to secure and enclose therein the insulative housing 3 together with the terminals 2.

When the camera module 5 is guided in, the flexible plates 15, 16 are pressed and deflected outwardly. The side faces 511, 513 of the base 51 should respectively maintains facing to the primary and end plates 11, 13. When the camera module 5 is completely inserted in and firmly fastened to the electrical connector 1, the engagements between the protrusions 5111, 5121, 5131, 5141 and the corresponding cutouts 151 may avoid incorrect assembly, which may result in unreliable electrical connection.

It can be understood that the invention is fit far the printed circuit board (not shown) having an opening therein for either a top loading thereby the contact soldering portions 24 and the grounding tabs 111, 121, 131 and 141 of the side shield 1 and the grounding tabs 44 of the bottom shield 4 being seated upon a top surface of the printed circuit board, or a bottom loading thereby the contact soldering portions 24 and the grounding tabs 111, 121, 131 and 141 of the side shield 1 and the grounding tabs 44 of the bottom shield 4 abutting against a bottom of the printed circuit board. Understandably, for such a dual-direction assembling, there is no improper obstacles fanned on the exterior surfaces of the side shield 1 which may interfere with the peripheral edges of the opening of the printed circuit board.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein. Especially, the electrical element of the electrical connector 100 is not limited to the camera module 4.

I claim:

1. An shielded electrical connector for receiving therein an electrical element, which is formed with a plurality of protrusions, comprising:

an insulative housing formed as a substantially flat plate;

a plurality of terminals mounted in the insulative housing;

a side shield comprising a plurality of separated shielding plates mounted round the insulative housing, each shielding plate having a plurality of flexible plates formed in U-shape with a free end extending downwardly and inwardly for standing against the electrical element; and a bottom shield attached to a bottom of the insulative housing, said bottom shield cooperating with said side shield to substantially encase therein the insulative housing together with the terminals.

2. The shielded electrical connector as claimed in claim 1, wherein at least one of said plurality of flexible plates defines thereon a cutout for receiving the corresponding protrusion of the electrical element.

3. The shielded electrical connector as claimed in claim 1, wherein each shielding plate of said side shield has a plurality of grounding tabs and said bottom shield has a plurality of grounding tabs extending outwardly and parallel to those grounding tabs of said shielding plates.

4. The shielded electrical connector as claimed in claim 1, wherein each terminal comprises a bending portion, a contacting portion electrically connecting the electrical element, and a soldering portion.

5. The shielded electrical connector as claimed in claim 4, wherein each shielding plate defines a plurality of engaging holes and the soldering portions of the terminals extend outwardly through said plurality of engaging holes.

6. The shielded electrical connector as claimed in claim 1, wherein each shielding plate has a plurality of fixing feet and said insulative housing defines a plurality of slits receiving said fixing feet.

7. The shielded electrical connector as claimed in claim 6, wherein said bottom shield has a plurality of inserting portions projecting upwardly from corner portions thereof, and said insulative housing defines a plurality of slots at corner portions thereof engaging with said inserting portions.

8. A shielded electrical connector comprising:

an insulative housing formed as asubstantially flat plate;

a plurality of contacts disposed in the housing, each of said contacts defining an upwardly extending contact portion and an outwardly extending horizontal tail;

a side shield horizontally surrounding and assembled to the housing, said side shield including a plurality of outwardly extending horizontal mounting/grounding tabs formed on all sides thereof, wherein the horizontal tails of the contacts and the mounting/grounding tabs are essentially coplanar with each other, and exterior surfaces of the side shield are configured to allow the side shield and the associated housing to be either bottom or top loaded relative to an opening in a printed circuit board for assembling.

9. The connector as claimed in claim 8, further including a bottom shield having mounting/grounding tabs coplanar with said horizontal tails and said mounting/grounding tabs.

10. The connector as claimed in claim 9, wherein said bottom shield shields a bottom face of the housing.

11. The connector as claimed in claim 9, wherein said bottom shield and said side shield are overlapped with each other on side walls of the housing.

12. The connector as claimed in claim 8, wherein said side shield defines recesses to allow the horizontal tails to extend therethrough laterally and outwardly for mounting to the printed circuit board.

13. A shielded electrical connector assembly comprising:

an inslulative housing;

a plurality of contacts disposed in the housing, each of said contacts defining an upwardly extending contact portion and a tail opposite to the contact portion;

a side shield horizontally surrounding and assembled to the housing, said side shield cooperating with the housing to define a receive space, said side shield including at least one flexible plate extending obliquely and downwardly from an outer position to an inner position with regard to the housing, said flexible plate defining an opening with a stop locking edge thereabouts; and an electronic module received in, the receiving space and defining a protrusion on a periphery thereof wherein cooperation between said protrusion and said opening performs not only orientation but also locking; wherein said shield further includes outwardly extending horizontal mounting/grounding tabs for supportably mounting the side shield and the associated housing to a printed circuit board which defines another opening to receive said housing therein.

14. The assembly as described in claim 13, further comprising a bottom shield attached to a bottom of the insulative housing, said bottom shield cooperating with said side shield to substantially encase therein the insulative housing together with the terminals.

* * * * *